US008468669B1

(12) United States Patent
Lin

(10) Patent No.: US 8,468,669 B1
(45) Date of Patent: Jun. 25, 2013

(54) HANDLE ASSEMBLY FOR A RIVET GUN

(76) Inventor: Yu-Ching Lin, New Taipei (TW)

( * ) Notice: Subject to any disclaimer, the term of this patent is extended or adjusted under 35 U.S.C. 154(b) by 0 days.

(21) Appl. No.: 13/420,028

(22) Filed: Mar. 14, 2012

(51) Int. Cl.
*B21J 15/10* (2006.01)
*B21J 15/22* (2006.01)

(52) U.S. Cl.
USPC ..... 29/243.525; 72/391.4

(58) Field of Classification Search
USPC ..... 72/391.4, 391.6, 391.8; 29/243.523, 29/243.524, 243.525, 243.526
See application file for complete search history.

(56) References Cited

U.S. PATENT DOCUMENTS 5,500,990 A * 3/1996 Wihan ..... 29/243.525
5,742,989 A * 4/1998 Subotsch ..... 29/243.525
6,014,801 A * 1/2000 Wilcox ..... 29/243.525
6,978,526 B1 * 12/2005 Lin ..... 29/243.525
7,032,281 B1 * 4/2006 Lin ..... 29/243.525
7,082,657 B1 * 8/2006 Lin ..... 29/243.525
7,082,658 B1 * 8/2006 Lin ..... 29/243.525
7,284,404 B2 * 10/2007 Lin ..... 72/114
8,091,195 B2 * 1/2012 Lin ..... 29/243.525

* cited by examiner

*Primary Examiner* — David B Jones
(74) *Attorney, Agent, or Firm* — Rabin & Berdo, P.C.

(57) ABSTRACT

A handle assembly for a rivet gun has a handle, a trigger and a control valve. The handle has an annular shoulder, an air inlet channel, an airflow passageway, an inlet hole, a mounting hole, a communication hole and an exhaust hole. The trigger is mounted in the handle and controls the communication between the air inlet channel and airflow passageway. The control valve is mounted in the mounting hole of the handle and has a stopper, a casing and a valve shaft. The control valve is controlled by high pressure without additional springs such that the fabrication and structure of the handle assembly are simplified and the fabricating and manufacturing cost is lowered.

4 Claims, 12 Drawing Sheets

HANDLE ASSEMBLY FOR A RIVET GUN

BACKGROUND OF THE INVENTION

1. Field of the Invention

The present invention relates to a handle assembly, and more particularly to a handle assembly that is mounted on a rivet gun, opens a control valve when trigged and repositions and closes the control valve when released. The handle is constructed without any springs.

2. Description of Related Art

A conventional rivet gun is used to rivet two boards such that the boards are securely mounted together by rivets. A rivet has a cap and a core pin. The cap is T-shaped and has an enlarged end and a mounting end. The core pin is mounted longitudinally through and protrudes out of the cap and has two ends and a ball formed on one end and adjacent to the mounting end of the cap.

A conventional rivet gun comprises a barrel, a handle, a trigger, a pin collector and a pneumatic cylinder.

The barrel has a front end, a rear end and a vise assembly that may vise and pull a core pin of a rivet on the front end into the barrel. The handle is mounted perpendicularly on the barrel and has air passageways. The collector is a jar mounted on the rear end of the barrel to collect the ejected core pins. The pneumatic cylinder is mounted movably under the handle and capable of activating the vise assembly through pneumatic and hydraulic means. Furthermore, the pneumatic cylinder may be connected to a high-pressure air source such as an air bottle to implement the ejection of the core pin.

When the rivet gun is used to rivet two pieces such as boards or plates together, a rivet is mounted through the pieces. The enlarged end of the cap of the rivet abuts an inside piece and the front end of the barrel of the rivet gun abuts the enlarged end. The trigger is pulled to activate the vise assembly to pull a core pin on the cap into the barrel. The ball on the core pin longitudinally compresses and radially expands the mounting end of the cap into T-shape so that the expanded mounting end hooks on an outside piece to complete the riveting process. Then, the air output by the high-pressure air source flows through the barrel from the front end to the rear end and sucks the broken core pin vised by the vise assembly backward into the collector.

Furthermore, the handle further has a control valve mounted in the handle and pressing against a recoil spring. When the trigger is pressed, ambient air flows into the handle and pushes a valve shaft of the control valve such that the control valve is opened. When the trigger is released, ambient air stops flowing into the handle and the recoil spring pushes the control valve back to an original position. However, the recoil spring increases the manufacturing complication and cost. Furthermore, the recoil spring ages and fatigues after repetitive compression and elongation, which causes the control valve to fail to open or close. Moreover, an inlet channel of the handle and a mounting hole in which the control valve is mounted are vertically arranged, which increases the manufacturing complication of the handle and raises the manufacturing cost.

To overcome the shortcomings, the present invention provides a handle assembly for a rivet gun to mitigate or obviate the aforementioned problems.

SUMMARY OF THE INVENTION

The main objective of the invention is to provide a handle assembly that is mounted on a rivet gun, opens a control valve when trigged and repositions and closes the control valve when released. The handle is constructed without any springs.

A handle assembly for a rivet gun in accordance with the present invention comprises a handle, a trigger and a control valve. The handle has an annular shoulder, an air inlet channel, an airflow passageway, an inlet hole, a mounting hole, a communication hole and an exhaust hole. The trigger is mounted in the handle and controls the communication between the air inlet channel and airflow passageway. The control valve is mounted in the mounting hole of the handle and has a stopper, a casing and a valve shaft. The control valve is controlled by high pressure without additional springs such that the fabrication and structure of the handle assembly are simplified and the fabricating and manufacturing cost is lowered.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
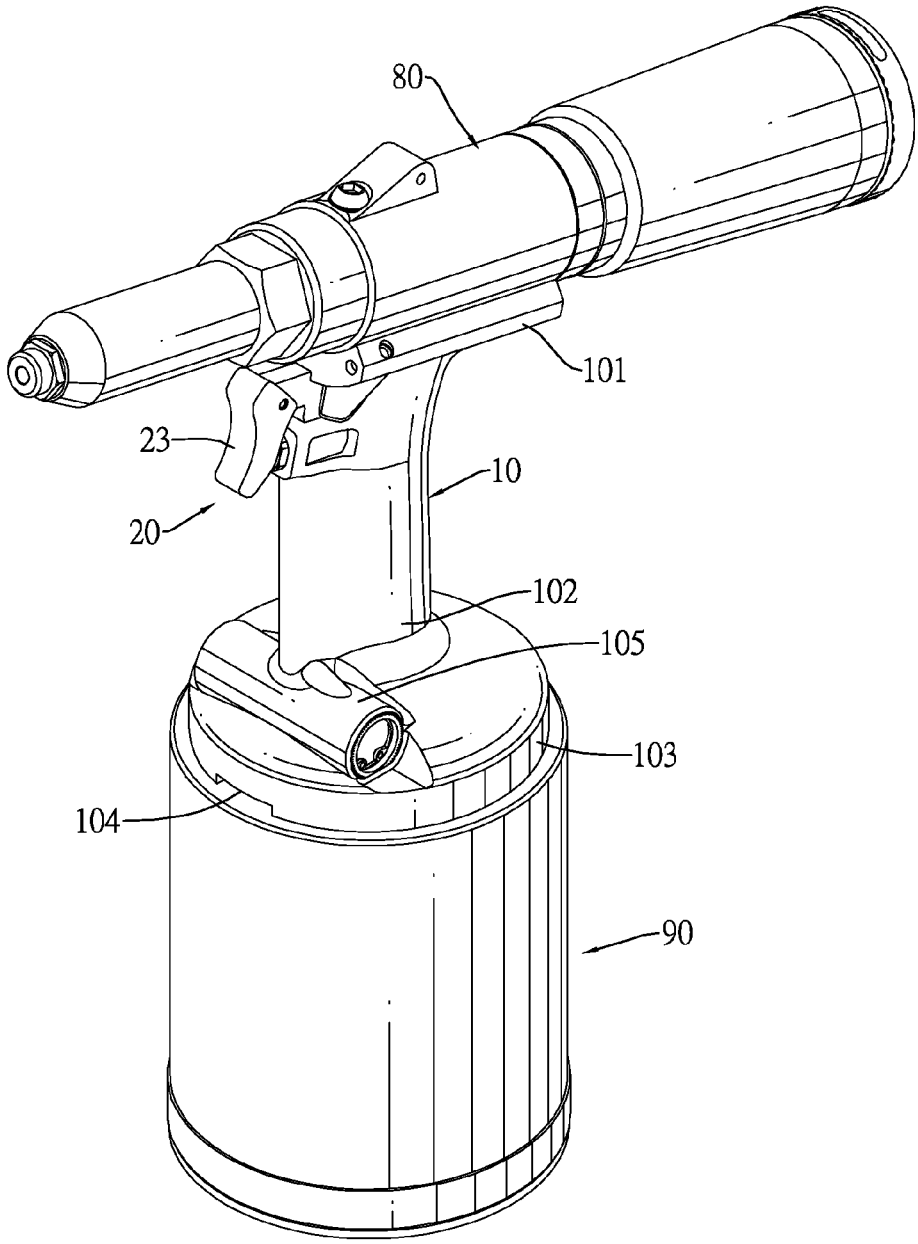
FIG. 1 is a perspective view of a handle assembly in accordance with the present invention mounted on a rivet gun.
Figure 2:
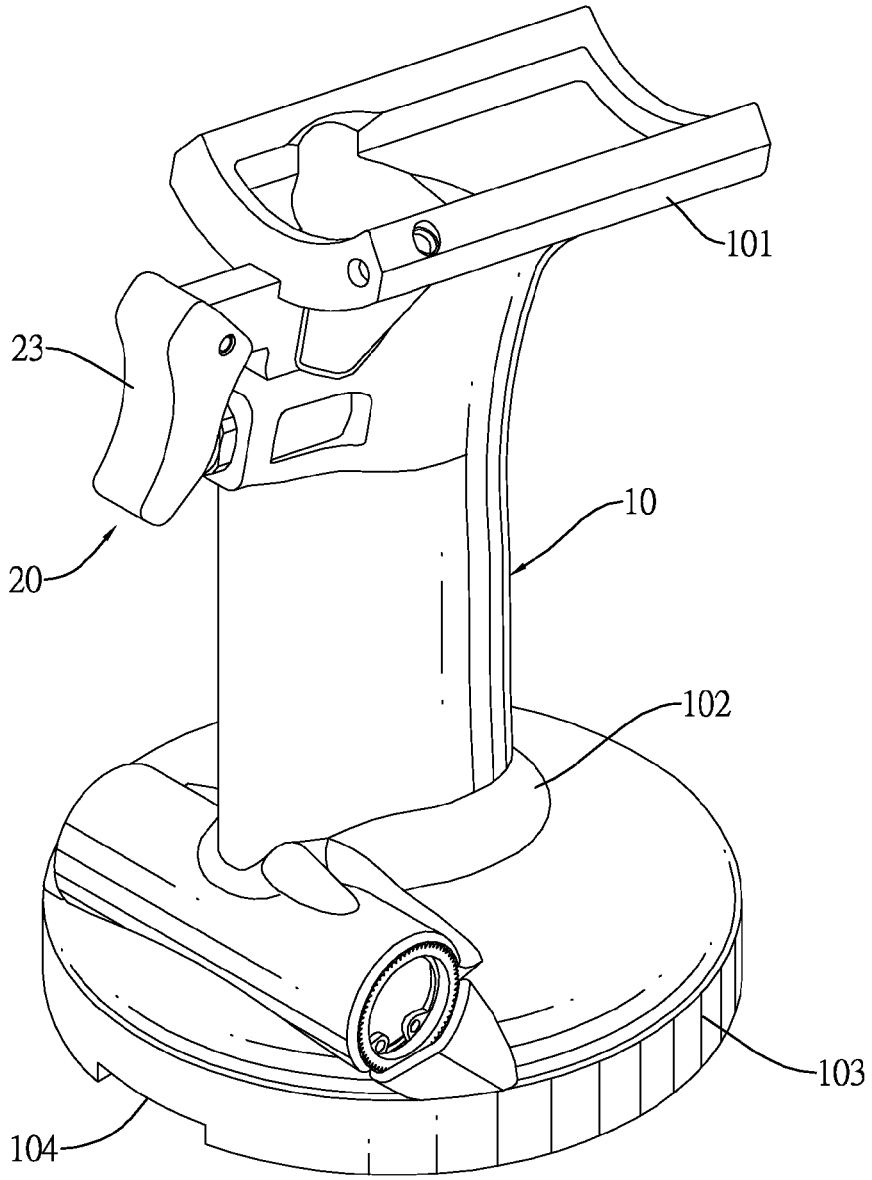
FIG. 2 is a perspective view of the handle assembly in FIG. 1.
Figure 3:
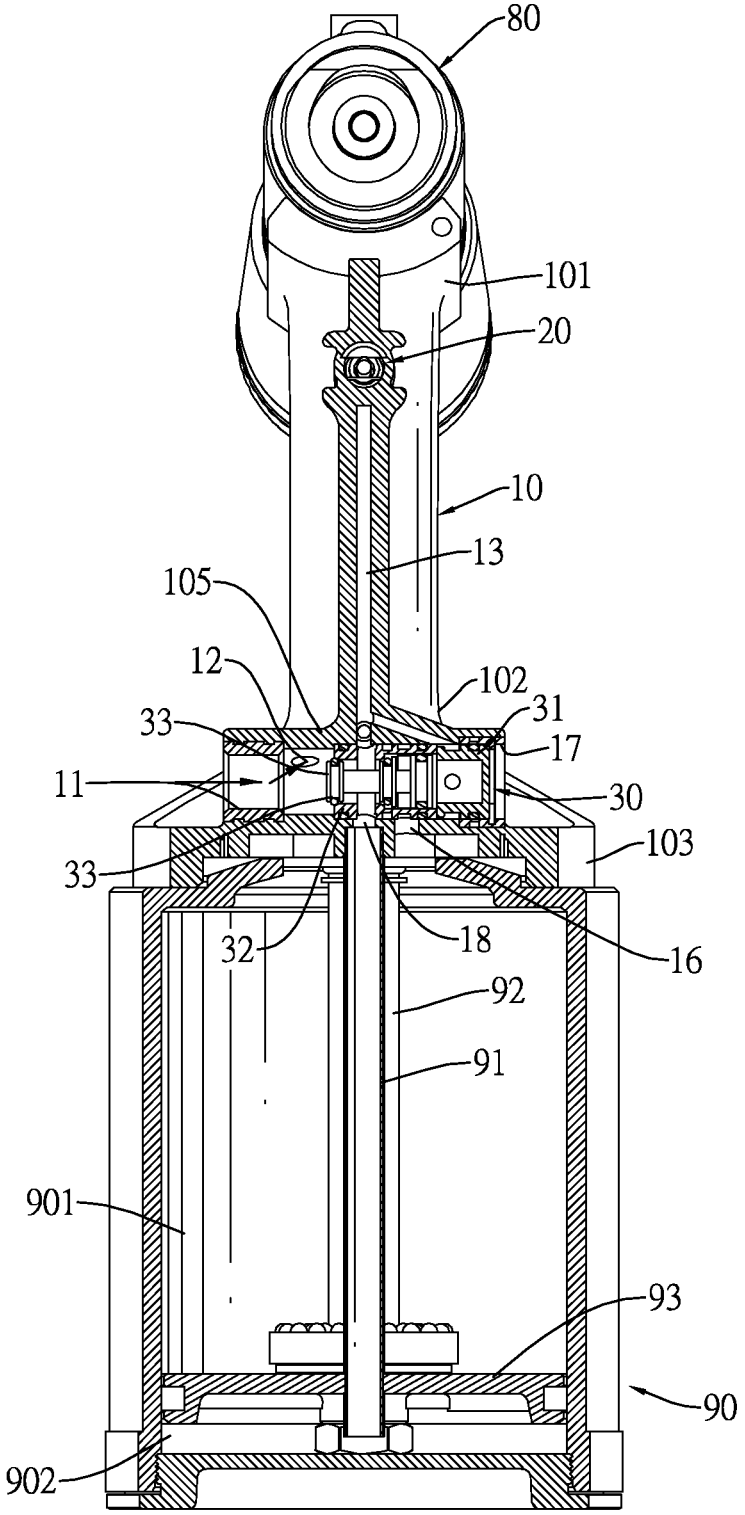
FIG. 3 is a cross sectional front view of the rivet gun with the handle assembly in FIG. 1.
Figure 4:
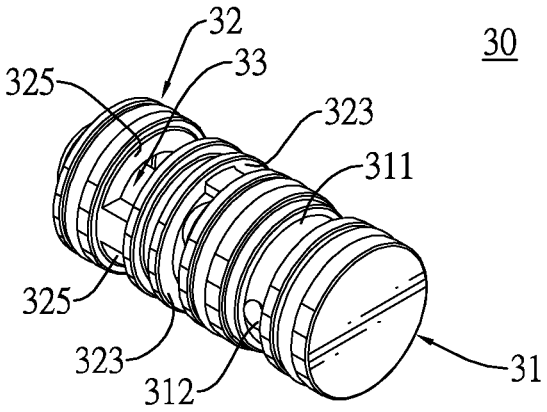
FIG. 4 is a perspective view of a control valve of the handle assembly in FIG. 1.

With reference to FIGS. 1 to 4, a handle assembly in accordance with the present invention is assembled with a barrel 80 and a hydraulic cylinder to form a rivet gun.

The hydraulic cylinder has a body 90, an air inlet tube 91, a hydraulic tube 92 and a piston head 93. The body 90 is hollow and has a cavity defined in the body 90. The air inlet tube 91 is mounted in the cavity. The hydraulic tube 92 is mounted in the cavity. The piston head 93 is mounted on a bottom end of the hydraulic tube 92, is mounted slidably around the air inlet tube 91 and divides the cavity into an upper chamber 901 and a lower chamber 902.

The handle assembly comprises a handle 10, a trigger 20 and a control valve 30.

The handle 10 has a top end 101, a bottom end 102, an annular shoulder 103, a cylindrical member 105, an air inlet channel 12, an airflow passageway 13, an inlet hole 11, a mounting hole 17, a communication hole 18 and an exhaust hole 16.

The top end 101 is mounted under the barrel 80.

The annular shoulder 103 is formed on and protrudes radially outward from the bottom end 102 and has an outer edge and a bottom.

The cylindrical member 105 is formed on the annular shoulder 103 and has two opposite ends.

The air inlet channel 12 is defined substantially vertically in the handle 10.

The airflow passageway 13 is defined substantially vertically in the handle 10.

The inlet hole 11 is defined in one end of the cylindrical member 105 and communicates with the air inlet channel 12.

The mounting hole 17 is defined in the other end of the cylindrical member 105, is located opposite to the inlet hole 11 and communicates with the airflow passageway 13. Furthermore, the mounting hole 17 is coaxial with and parallel to the inlet hole 11.

The communication hole 18 is defined in the bottom of the annular shoulder 103 and communicates with the mounting hole 17.

The exhaust hole 16 is defined in the bottom of the annular shoulder 103 and communicates with the communication hole 18 and atmosphere.

The trigger 20 is mounted on the handle 10 and is connected to the air inlet channel 12 and the airflow passageway 13. When the trigger 20 is pressed, the air inlet channel 12 communicates with the airflow passageway 13. When the trigger 20 is released, the air inlet channel 12 is isolated hermetically from the airflow passageway 13.

Figure 5:
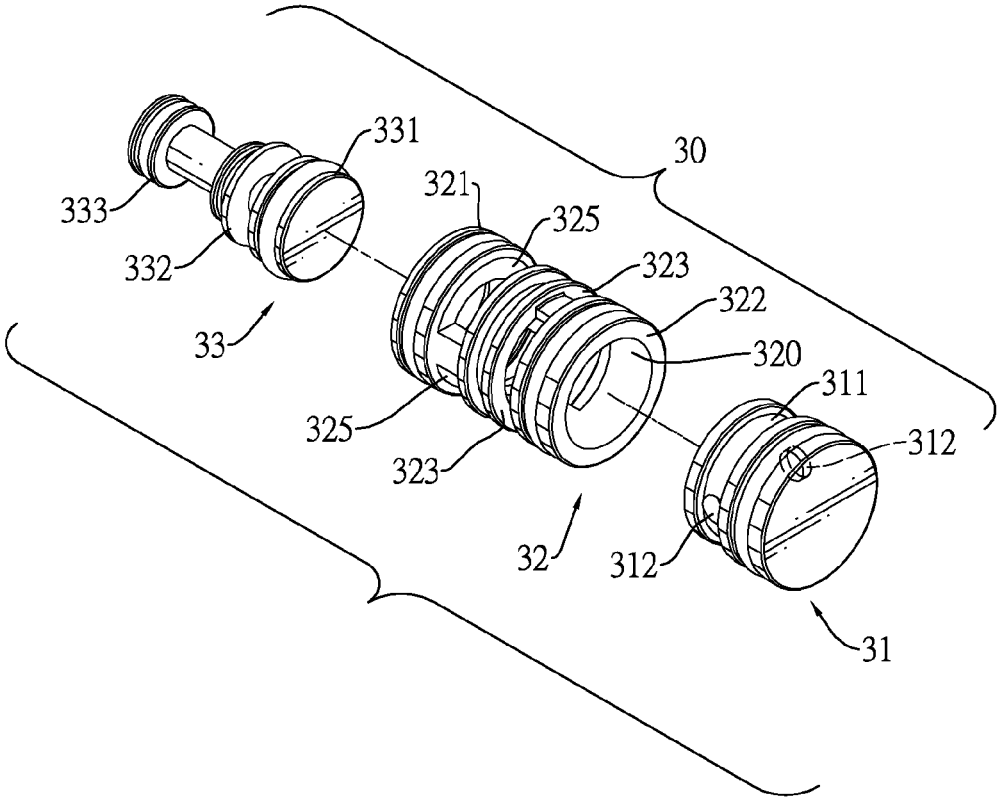
FIG. 5 is an exploded perspective view of the control valve of the handle assembly in FIG. 4.
Figure 6:
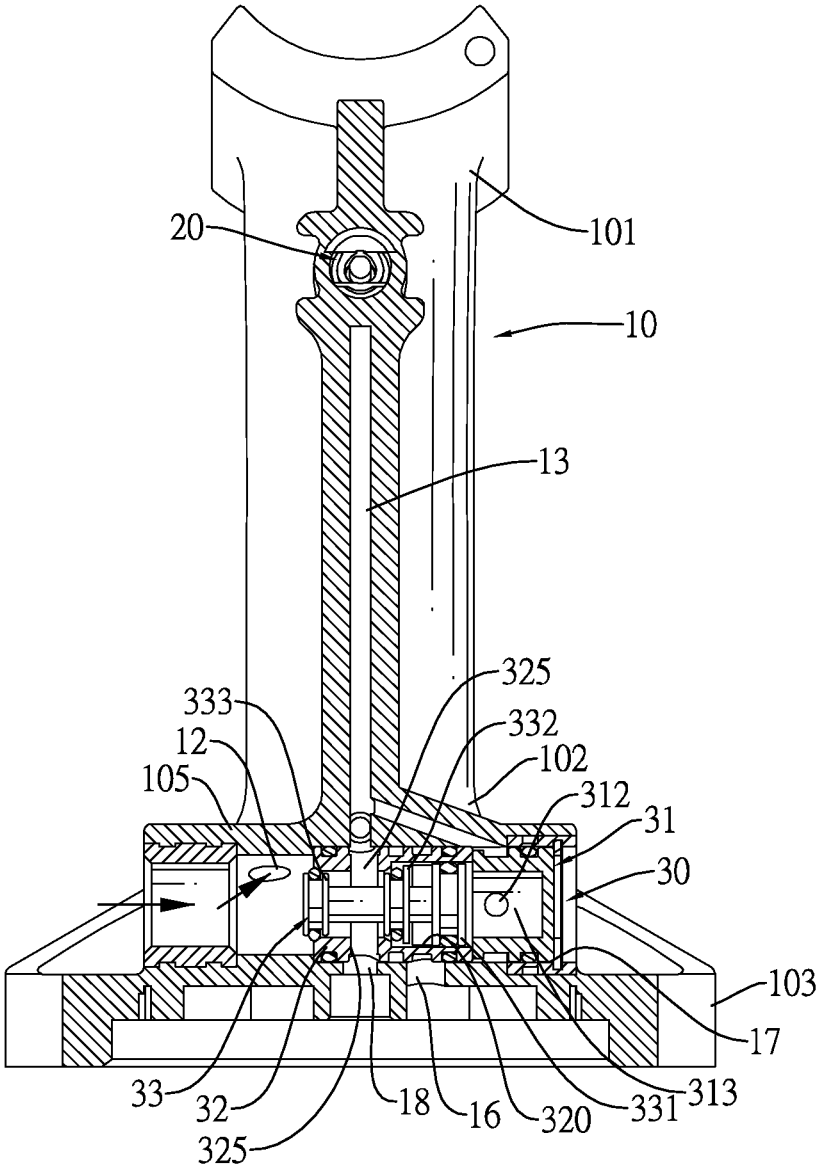
FIG. 6 is a cross sectional front view of the handle assembly in FIG. 3.
Figure 7:
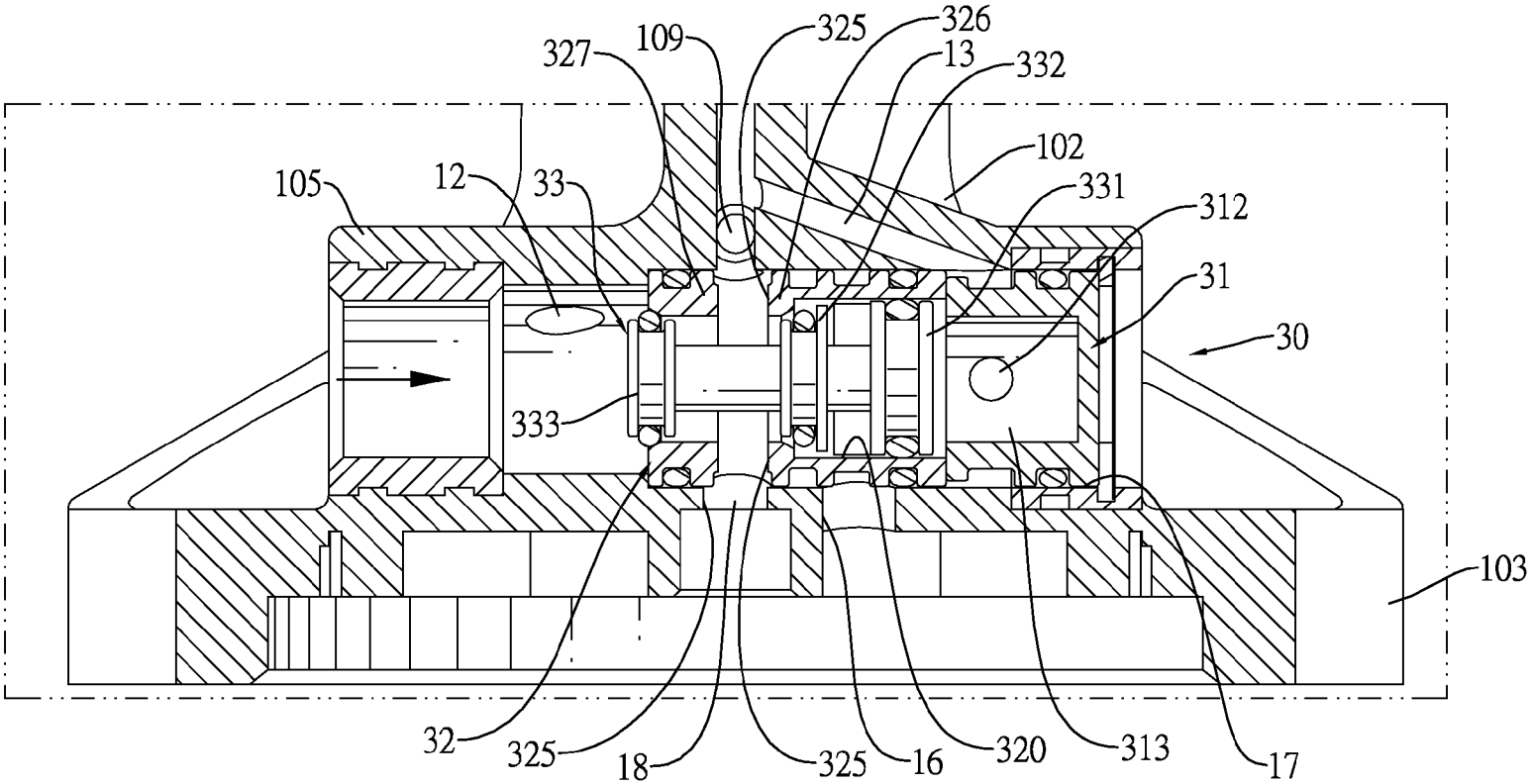
FIG. 7 an enlarged cross sectional front view of the handle assembly in FIG. 6.
Figure 8:
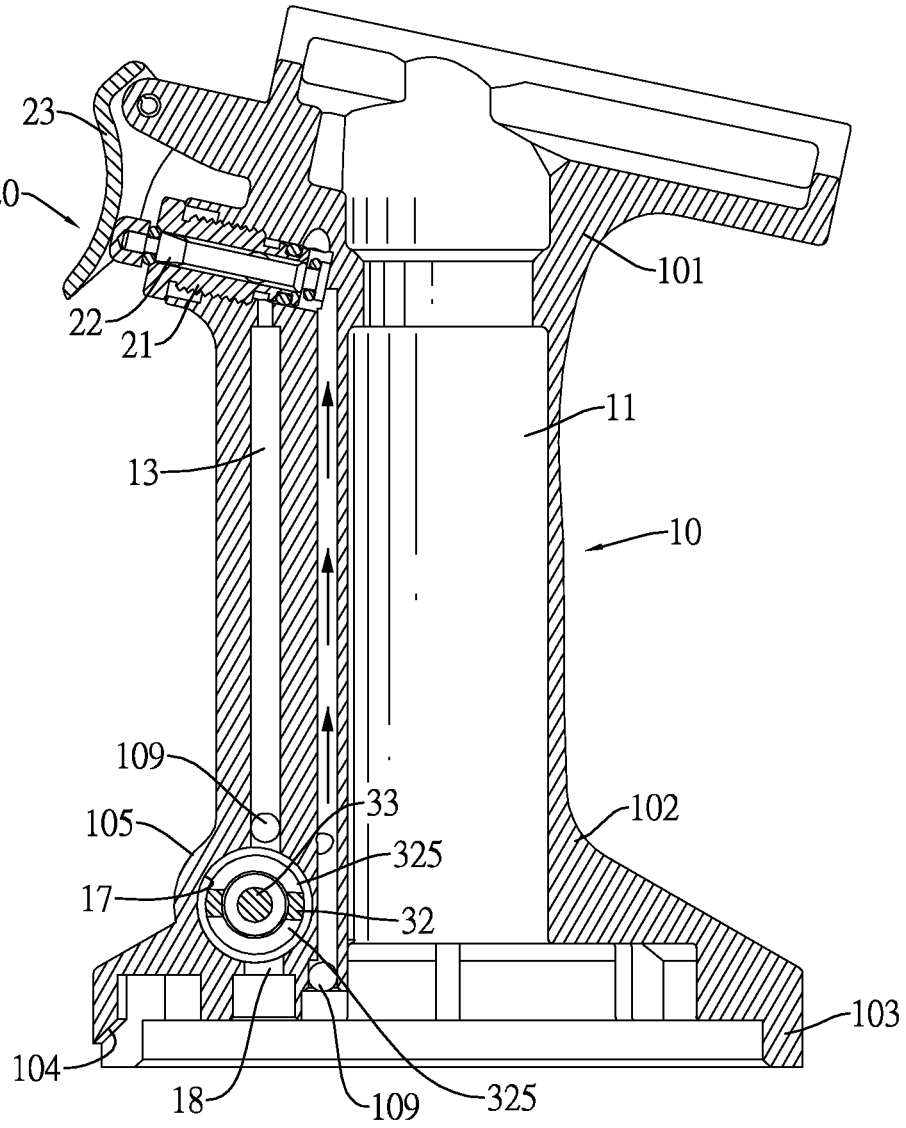
FIG. 8 is a cross sectional side view of the handle assembly in FIG. 6.
Figure 9:
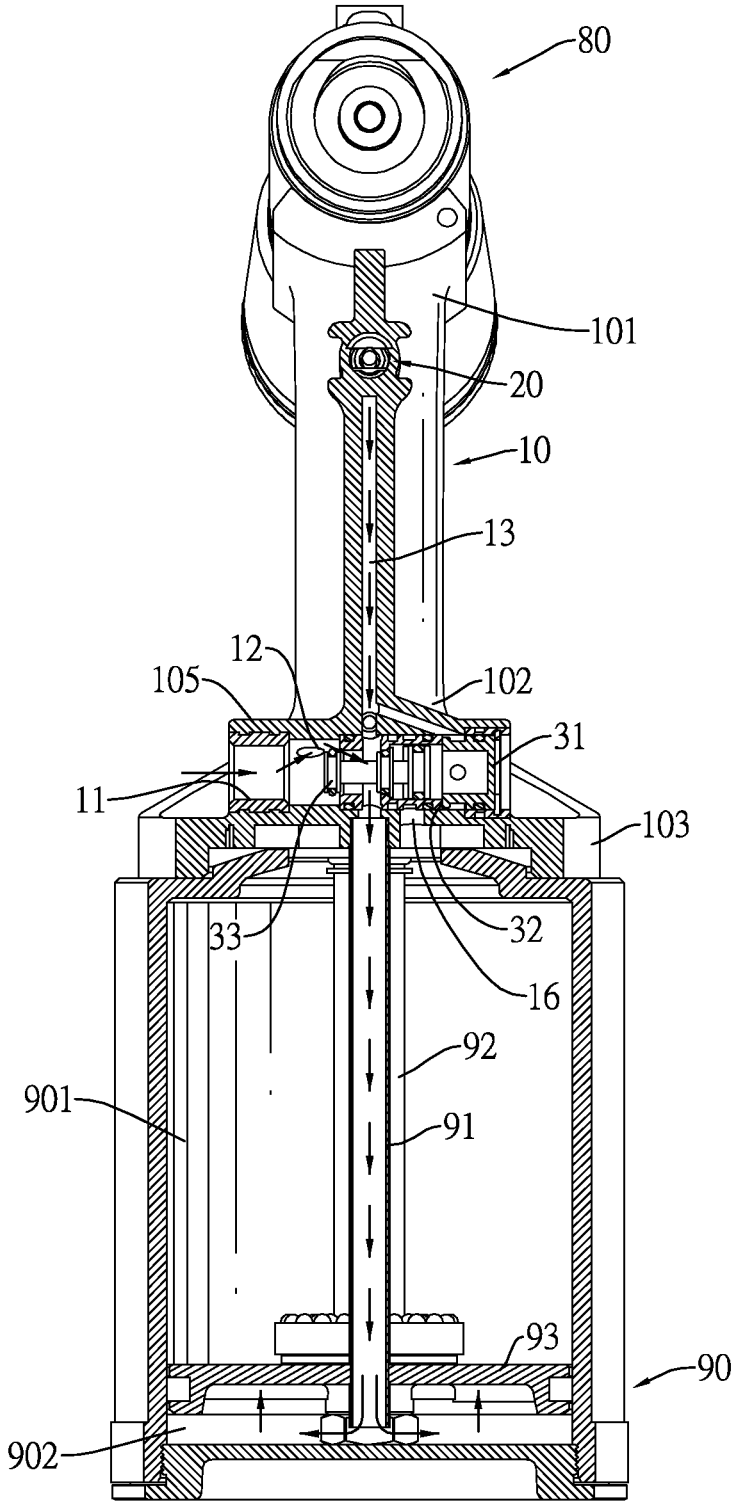
FIG. 9 is an operational cross sectional front view of the rivet gun with the handle assembly in FIG. 3.
Figure 10:
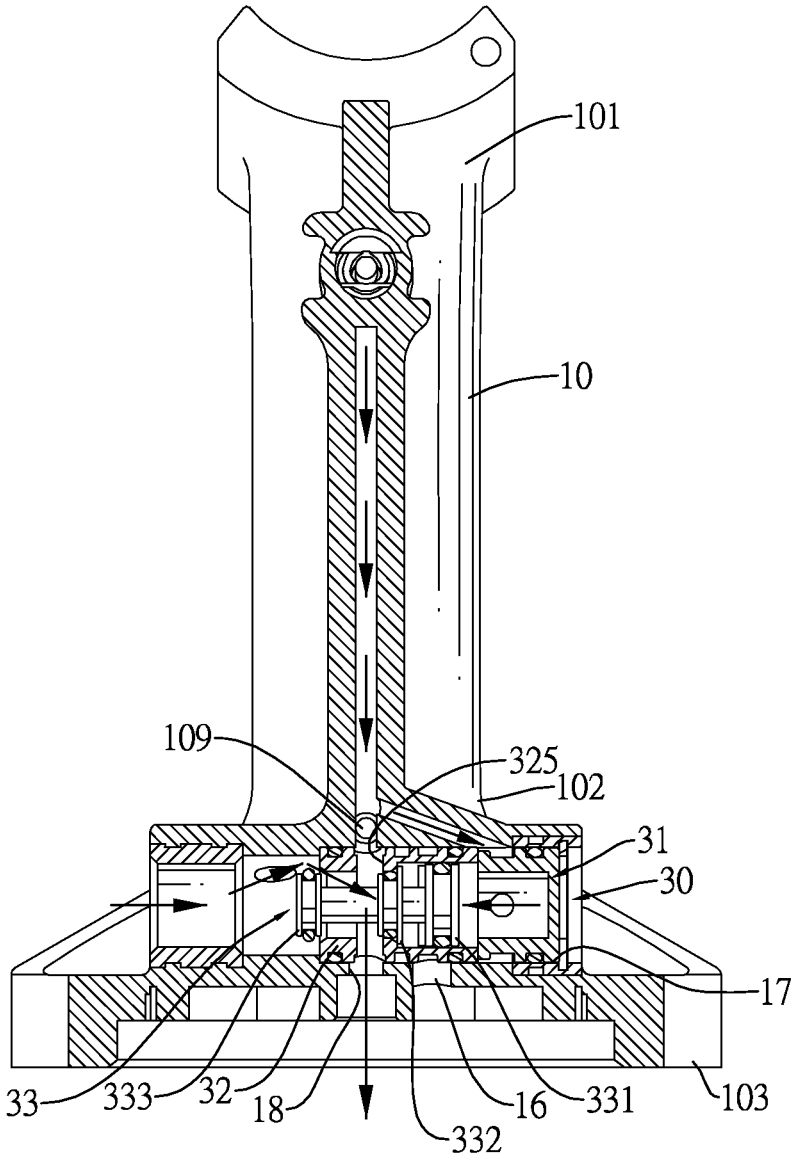
FIG. 10 is an operational cross sectional front view of the handle assembly in FIG. 9.
Figure 11:
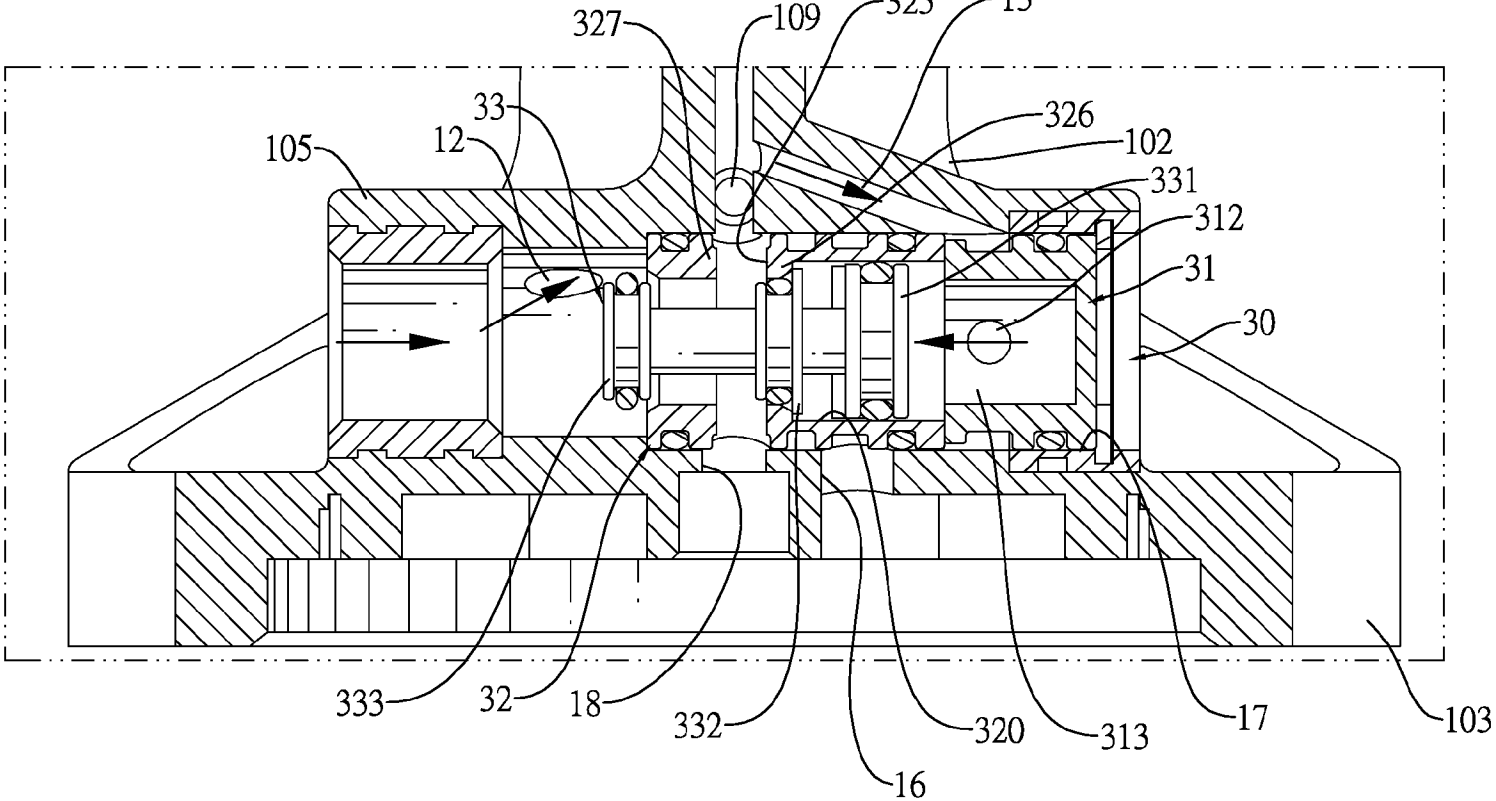
FIG. 11 is an enlarged and operational cross sectional front view of the handle assembly in FIG. 10.
Figure 12:
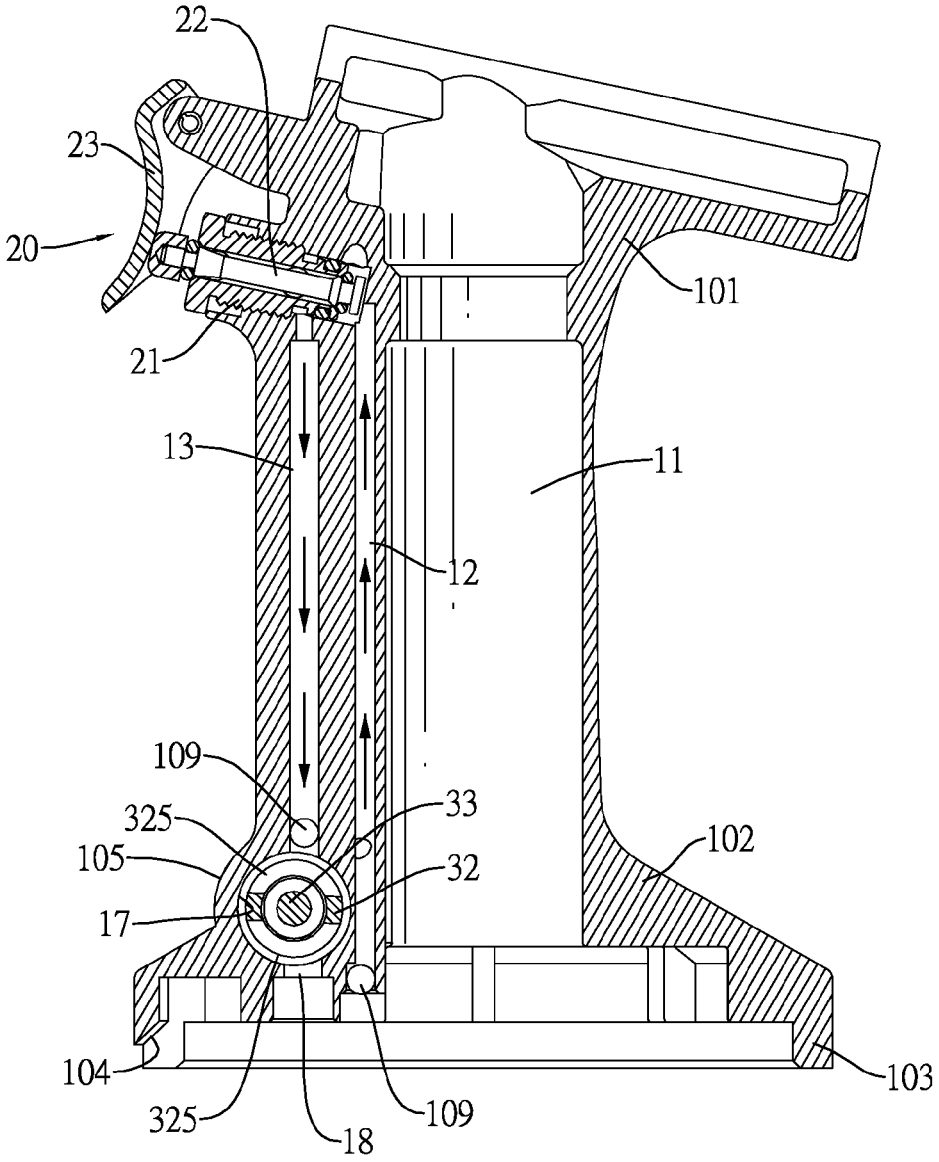
FIG. 12 is an operational cross sectional side view of the handle assembly in FIG. 11.

With further reference to FIGS. 5 to 7, the control valve 30 is mounted in the mounting hole 17 of the handle 10 and has a stopper 31, a casing 32 and a valve shaft 33.

The stopper 31 has a closed outside end, an open inside end, an outer surface, a cavity 313 and at least one transverse hole 312 and may further have a resilient seal ring. The cavity 313 is defined in the stopper 31 and communicates with the open inside end. The at least one transverse hole 312 is defined radially through the stopper 31 and communicates with the cavity 313 and the airflow passageway 13. The resilient seal ring is mounted around the outer surface of the stopper 31 to improve hermetic characteristics.

The casing 32 has a first end 322, a second end 321, an outer surface, a central hole 320, a first inner shoulder 326, a second inner shoulder 327, at least one air inlet opening 325 and at least one exhaust opening 323 and may further have a resilient seal ring. The first end 322 abuts the open inside end of the stopper 31. The central hole 320 is defined axially through the casing 32 and has an inner surface. The first inner shoulder 326 is formed on and protrudes radially inward from the inner surface of the central hole 320 and is located near the first end 322. The second inner shoulder 327 is formed on and protrudes radially inward from the inner surface of the central hole 320 and is located near the second end 321. The at least one air inlet opening 325 is defined radially through the casing 32, communicates with the central hole 320 and is located adjacent to the first inner shoulder 326. The at least one exhaust opening 323 is defined radially through the casing 32 and communicates with the central hole 320 and the exhaust hole 16 of the handle 10. The resilient seal ring is mounted around the outer surface of the casing 32 to improve hermetic characteristics.

The valve shaft 33 is mounted slidably in the central hole 320 of the casing 32 and has a sealing flange 331, an exhaust flange 332 and an air inlet flange 333. The sealing flange 331 is formed on and protrudes radially outward from the valve shaft 33, faces the cavity 313 of the stopper 31 and hermetically contacts the inner surface of the central hole 320. The exhaust flange 332 is formed on and protrudes radially outward from the valve shaft 33. The air inlet flange 333 is formed on and protrudes radially outward from the valve shaft 33, locates the exhaust flange 332 between the sealing flange 331 and the air inlet flange 333 and selectively hermetically contacts the second inner shoulder 327. When the air inlet flange 333 hermetically contacts the second inner shoulder 327, the exhaust flange 332 is separated from the first inner shoulder 326. Preferably, each of the sealing flange 331, exhaust flange 332 and air inlet flange 333 has a resilient seal ring mounted thereon to improve hermetic characteristics.

The inlet hole 11 of the handle 10 may be connected to a high pressure source such as high pressure air cartridge. The high pressure air from the high pressure source enters the air inlet channel 12 through the inlet hole 11. The operation of the handle assembly will be described as follows.

With further reference to FIGS. 3, 6, 7 and 8, when the trigger 20 is not pressed, the high pressure is prevented from flowing into the airflow passageway 13. The exhaust flange 332 is separated from the first inner shoulder 326 to make the communication hole 18, the at least one exhaust opening 323 and the exhaust hole 16 communicate with one another. Because the pressure of the exhaust hole 16 (1 atm) communicating with the atmosphere is smaller than the pressure of the inlet hole 11 (the pressure of the high pressure cartridge that is larger than 1 atm), the air inlet flange 333 hermetically contacts the second inner shoulder 327 to isolate the inlet hole 11 of the handle 10 from the central hole 320 of the casing 32.

With further reference to FIGS. 9, 10, 11 and 12, when the trigger 20 is pressed, the high pressure air flows through the airflow passageway 13 and the cavity 313 of the stopper 31 and pushes the sealing flange 331 of the valve shaft 33 to drive the valve shaft 33 to move away from the stopper 31. Then the air inlet flange 333 is separated from the second inner shoulder and makes the inlet hole 11 of the handle 10 communicate with the central hole 320 of the casing 32. Therefore, the high pressure air flows sequentially through the inlet hole 11, central hole 320 and communication hole 18.

With reference to FIGS. 3, 6, 7 and 8 again, when the trigger 20 is released, the pressure of the exhaust hole 16 of the handle 10 communicating with the atmosphere is smaller than the pressure of the communication hole 18, which drives the valve shaft 33 to move toward the stopper 31 and makes the air inlet flange 333 hermetically contact the second inner shoulder 327 again. At the same time, the exhaust flange 332 is separated from the first inner shoulder 326.

In a preferred embodiment, the annular shoulder 103 of the handle 10 further has an exhaust notch 104 defined through the outer edge of the annular shoulder 103 and communicating with the exhaust hole 16 and atmosphere. When the trigger 20 is pressed, the piston head 93 in the hydraulic cylinder is driven by the high pressure air to move upward so that the upper chamber 901 is compressed and decreased in volume. The air inside the upper chamber 901 is discharged to the atmosphere through the exhaust notch 104. When the trigger 20 is released, the piston head 93 moves downward and expands the upper chamber 901 so that outside air is sucked into the expanding upper chamber 901 through the exhaust notch 104.

In a preferred embodiment, the stopper 31 of the control valve 30 has an annular groove 311 defined in the outer surface and communicating with the airflow passageway 13 and the at least one transverse hole 312.

In a preferred embodiment, the trigger 20 has a housing 21, a press shaft 22 and a cover 23. The housing 21 is mounted in the handle 10 and communicates with the air inlet channel 12 and the airflow passageway 13. The press shaft 22 is mounted in the housing 21 and selectively makes the air inlet channel 12 and the airflow passageway 13 communicate with each other. The cover 23 is mounted pivotally on the handle 10 and presses against a front end of the press shaft. Pressing the cover 23 drives the press shaft 22 to make the air inlet channel 12 communicate with the airflow passageway 13.

The design of the inlet hole 11, communication hole 18, exhaust hole 16 and control valve 30 supplies the rivet gun incorporated with the handle assembly with high pressure air by pressing the trigger 20 so that the rivet gun is able to fire a rivet while excessive inside air is discharged through the exhaust hole 16 and exhaust notch 104 communicating with the atmosphere. After the trigger 20 is released, the pressure difference between the inlet hole 11 (where the pressure is larger than 1 atm) and the exhaust notch (where the pressure is 1 atm) makes the valve shaft 33 of the control valve 30 move back to an original position to prevent high pressure air from entering the rivet gun. Therefore, the high pressure is efficiently saved. Because the control valve 30 is controlled by high pressure without additional springs, the fabrication and structure of the handle assembly are simplified and the fabricating and manufacturing cost is lowered. Furthermore, because the mounting hole 17 and the inlet hole 11 are coaxial and parallel instead of being perpendicular to each other, the space layout of the handle 10 is simplified, the production rate thereof is increased and the manufacturing cost is lowered.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A handle assembly for a rivet gun comprising:

a handle having
- a top end;
- a bottom end;
- an annular shoulder formed on and protruding radially outward from the bottom end and having an outer edge and a bottom;
- a cylindrical member formed on the annular shoulder and having two opposite ends;
- an air inlet channel defined in the handle;
- an airflow passageway defined in the handle;
- an inlet hole defined in one end of the cylindrical member and communicating with the air inlet channel;
- a mounting hole defined in the other end of the cylindrical member, located opposite to the inlet hole and communicating with the airflow passageway;
- a communication hole defined in the bottom of the annular shoulder and communicating with the mounting hole; and
- an exhaust hole defined in the bottom of the annular shoulder and communicating with the communication hole and atmosphere;

a trigger mounted on the handle and connected to the air inlet channel and the airflow passageway; wherein when the trigger is pressed, the air inlet channel communicates with the airflow passageway, and when the trigger is released, the air inlet channel is isolated hermetically from the airflow passageway; and a control valve mounted in the mounting hole of the handle and having a stopper having
- a closed outside end;
- an open inside end;
- an outer surface;
- a cavity defined in the stopper and communicating with the open inside end; and
- at least one transverse hole defined radially through the stopper and communicating with the cavity and the airflow passageway;

a casing having
- a first end abutting the open inside end of the stopper;
- a second end;
- an outer surface;
- a central hole defined through the casing and having an inner surface;
- a first inner shoulder formed on and protruding radially inward from the inner surface of the central hole and located near the first end;
- a second inner shoulder formed on and protruding radially inward from the inner surface of the central hole and located near the second end;
- at least one air inlet opening defined radially through the casing, communicating with the central hole and located adjacent to the first inner shoulder; and
- at least one exhaust opening defined radially through the casing and communicating with the central hole and the exhaust hole of the handle; and a valve shaft mounted slidably in the central hole of the casing and having
- a sealing flange formed on and protruding radially outward from the valve shaft, facing the cavity of the stopper and hermetically contacting the inner surface of the central hole;
- an exhaust flange formed on and protruding radially outward from the valve shaft; and
- an air inlet flange formed on and protruding radially outward from the valve shaft, locating the exhaust flange between the sealing flange and the air inlet flange and selectively hermetically contacting the second inner shoulder, wherein when the air inlet flange hermetically contacts the second inner shoulder, the exhaust flange is separated from the first inner shoulder.

2. The handle assembly as claimed in claim 1, wherein the annular shoulder of the handle further has an exhaust notch defined through the outer edge of the annular shoulder and communicating with the exhaust hole and atmosphere.

3. The handle assembly as claimed in claim 2, wherein the stopper of the control valve has a annular groove defined in the outer surface and communicating with the airflow passageway and the at least one transverse hole.

4. The handle assembly as claimed in claim 3, wherein the trigger has
- a housing mounted in the handle and communicating with the air inlet channel and the airflow passageway;
- a press shaft mounted in the housing and selectively making the air inlet channel and the airflow passageway communicate with each other; and
- a cover mounted pivotally on the handle and pressing against a front end of the press shaft, wherein pressing the cover drives the press shaft to make the air inlet channel communicate with the airflow passageway.

* * * * *